US006151729A

United States Patent [19]

Yean

[11] Patent Number: 6,151,729

[45] Date of Patent: Nov. 28, 2000

[54] SWITCH VALVE FOR USE IN A RINSING SHOWER HEAD MOUNTED TO A KITCHEN SINK

[75] Inventor: Her-Far Yean, Chang-Hua, Taiwan

[73] Assignee: Chya Ye Industrial Co., Ltd., Chang-Hua, Taiwan

[21] Appl. No.: 09/428,473

[22] Filed: Oct. 28, 1999

[51] Int. Cl.[7] ..... B05B 1/16

[52] U.S. Cl. ..... 4/675; 239/443; 239/449

[58] Field of Search ..... 4/675–678; 239/443, 239/448, 449

[56] References Cited

U.S. PATENT DOCUMENTS

| | | | |
|---|---|---|---|
| 4,204,646 | 5/1980 | Shames et al. | 239/443 |
| 5,145,114 | 9/1992 | Munch | 239/449 |
| 5,383,604 | 1/1995 | Boesch | 239/449 |
| 5,707,011 | 1/1998 | Bosio | 239/449 |
| 5,744,033 | 4/1998 | Bertrand et al. | 4/675 |

*Primary Examiner*—Charles R. Eloshway
*Attorney, Agent, or Firm*—Dougherty & Troxell

[57] ABSTRACT

An improved switch valve for use in a rinsing shower head embodiment mounted adjacent to a kitchen sink has a spring biased valve shaft having one end connected to a finger operated press button board which is pivotally operated in two positions so as to permit water to be selectively discharged via two outlets. The spring biased valve shaft has two sealing bulges which can block the two outlets in a normal state whereby when the press button board is pressed at either end, the switch valve permits water to be selectively discharged via either one of the two water outlets and the rinsing shower head embodiment is automatically closed by the valve shaft when the press button board is free of a finger's compression. So, it facilitates a person to turn on and off a rinsing shower head and to select the operation modes of the same.

1 Claim, 4 Drawing Sheets

SWITCH VALVE FOR USE IN A RINSING SHOWER HEAD MOUNTED TO A KITCHEN SINK

BACKGROUND OF THE INVENTION

The present invention relates to an improved switch valve for use in a rinsing shower head mounted adjacent to a kitchen sink. The switch valve has a spring biased valve shaft having one end connected to a finger operated press button board which is pivotally operated in two positions so as to permit water to be selectively discharged via two outlets. The spring biased valve shaft has two sealing bulges which can block the two outlets in a normal state whereby when the press button board is pressed at either end, the switch valve permits water to be selectively discharged via either one of the two water outlets and the rinsing shower head is automatically closed by the valve shaft on the press button board being free of a finger's compression. So, it facilitates a person to turn on and off a rinsing shower head and to select the operation modes of the same.

In general, a conventional rinsing shower head is equipped with a switch valve which is provided with a valve shaft having only one sealing bulge disposed thereon. Such a valve shaft retractably operated by a bias spring is selectively movable between two water outlets by way of activation of a pivotal press button board covered by a soft cover. That soft cover can be either pressed at the top or the bottom portion so as to selectively coordinate the water discharge paths. This kind of switch valve has a disadvantage in practical operation. Due to its simple structure, the switch valve can only vary the flow path of discharged water. There is no way to cut off or turn off a rising shower head in operation by way of such a switch valve. In case the water rinsing shower head is placed at a distance from a water source, a person is troubled to go back and forth to turn on or off an external valve repeatedly if he or she is concerned with saving of water resource.

SUMMARY OF THE INVENTION

Therefore, the primary object of the present invention is to provide an improved switch valve for use in a rinsing shower head disposed at a kitchen sink. The switch valve has a valve shaft which has a pair of sealing bulges disposed at the middle section thereof and is biased by a spring. The valve shaft connected to a press button board is linearly movable back and forth when the press button board is pivoted at either end so that the valve shaft can be positioned at two different states for water to be discharged via two various outlets. As long as the press button board is free of compression of a finger, water is automatically cut off as a result of the valve shaft resuming its normal position by the bias spring to seal water outlets in the rinsing shower head. Such a switch valve frees people of constantly turning on and off a valve mannually whereby time of operation on a rinsing shower head is spared and water resource can be effectively saved.

DETAILED DESCRIPTION OF THE PREFERRED EMBODIMENT

Figures 1, 1A:
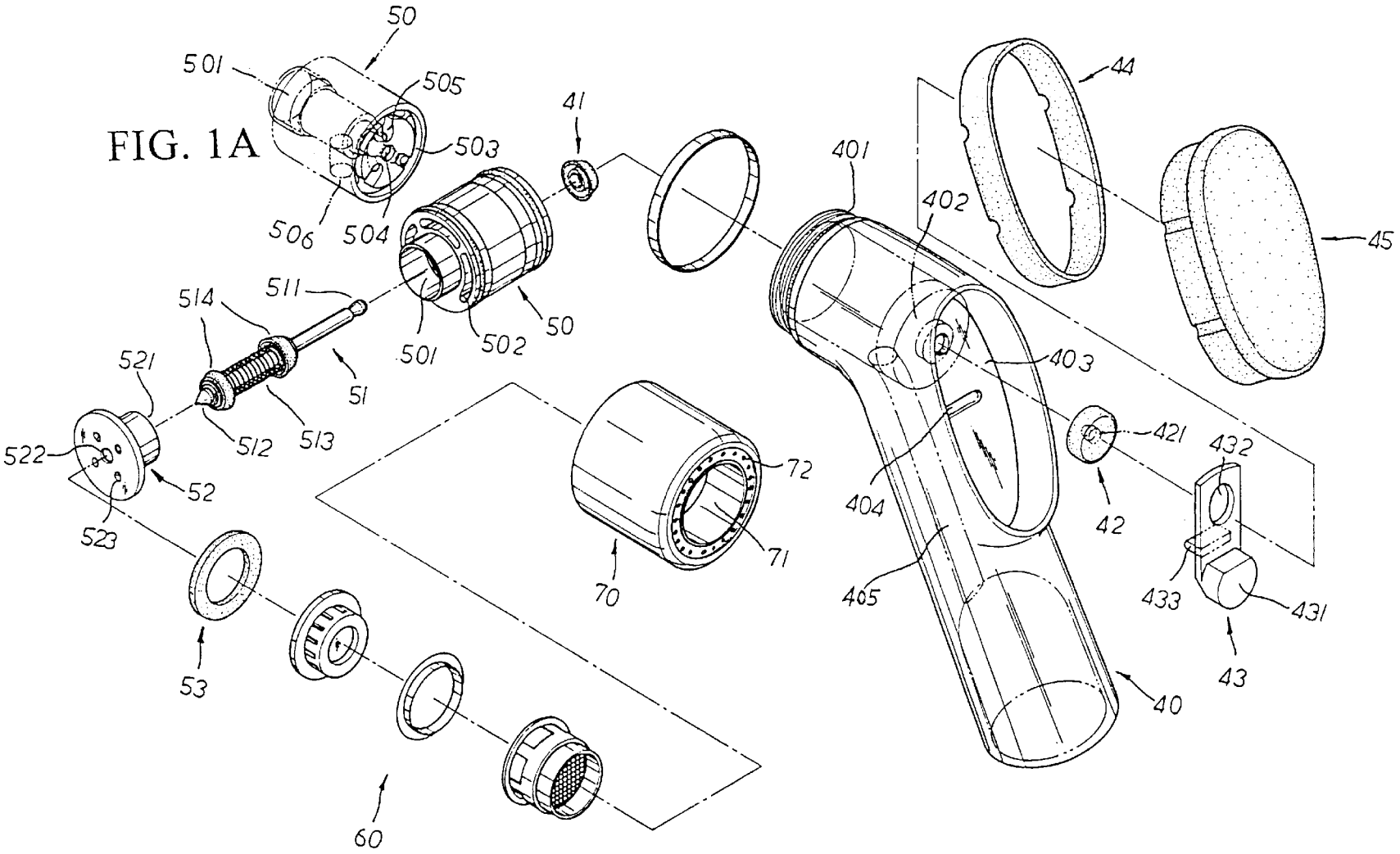
FIG. 1 is a perspective diagram showing the exploded components of the present invention.
FIG. 1A is a diagram showing the detailed structure of the switch valve of the present invention.

Referring to FIG. 1, the present invention is comprised of a rinsing shower head embodiment 40, a small seal ring 41, a flexible deformable cap 42, a press button board 43, a sealing hoop 44, a flexible soft cover 45, a switch valve 50, a valve shaft 51, a discharge head 52, a large seal ring 53, a bubble generator 60 and an outlet cap 70.

The rinsing shower head embodiment 40 is a slightly curved tubular body having a front water discharge portion and a rear holding handle portion. The front water discharge portion is of a two-stage structure having a small front end provided with outer locking threads 401. At the rear end of the water discharge portion is disposed a two-stage circular element having a passage hole 402 for mounting of the valve shaft. On the back of the rinsing shower head embodiment 40 is disposed a recessed oval-shaped control chamber 403 in which an abutment groove 404 is located. The deformable cap. 42 is of a short circular disc shape having a central activation hole 421. The press button board 43 has a press section 431 and a driving section 432 having an oval hole defined thereon. To the opposite side of the press section 431 and at the middle position between the driving section 432 and the press section 431 is disposed a pivot projection 433.

The switch valve 50 is a two-stage cylinder having a long large diametered section and a short small diametered section. At each edge of the long large diametered section is disposed a seal ring. A two-staged water inlet passage 501 extends from the short small diametered section into the large diametered section of the switch valve 50. There are a plurality of arc shaped outlet slot passages 502 defined on the vertical face at the junction of the small diametered section and the large diametered section of the switch valve 50. An arc-shaped bypass 503 communicating with the outlet slots 502 of the switch valve 50 is disposed at the external end of the large diametered section of the switch valve 50.

A fixing hole 504 is located at an end face of the large diametered section of the switch valve 50. There are 3 evenly and radially distributed water outlet holes 505 disposed around the fixing hole. The fixing hole 504 and the 3 water outlet holes 505 are in communication with the water inlet passage 501 of the switch valve 50. A water inlet hole 506 extends into the large diametered section of the switch means 50 from the external peripheral surface thereof and communicates with the water inlet passage 501.

The valve shaft 51 is an elongated rod having a ball-shaped driving end 511 at the rear end and the front end is provided with a conic dodge head 512. A bias spring 513 is disposed at the front section of the valve shaft 51. At each end of the bias spring 513 is disposed a sealing bulge 514 supported in place by way of limiting plates and C-shaped retainer rings (not shown).

The discharge head 52 is a two-stage cylinder including a small diametered central tube section 521 and a large diametered disc section having a central location hole 522 with four evenly distributed discharge holes 523 disposed around the discharge holes 523. In communication with the central tube section 521 are the central location hole 522 and the discharge holes 523. The outlet cap 70 is a tubular cap having a large receiving cavity 71 and a plurality of water outlet holes 72 disposed on the peripheral wall of the outlet cap 70 at the front end thereof. The receiving cavity 71 extends a proper length into the outlet cap 70 which is provided with internally threaded section 73 at the other end opposite to the receiving cavity 71.

Figure 2:
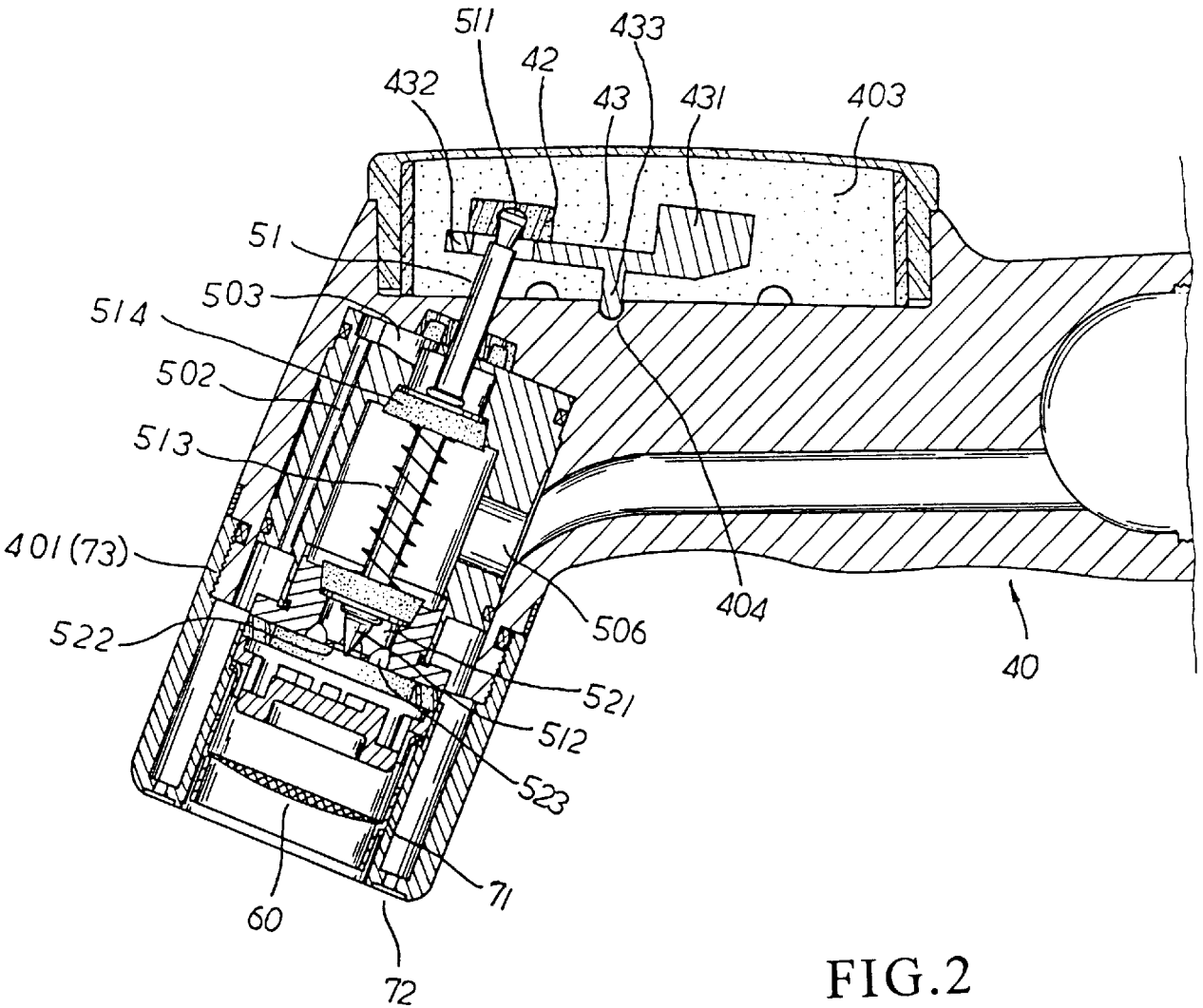
FIG. 2 is a sectional diagram showing the detailed structure of the rinsing shower head of the present invention.

In assembly, as shown in FIG. 2, the valve shaft 51 is led into engagement with the fixing hole 504 and the sealing bulges 514 disposed at the middle section of the valve shaft 51 is just engaged with the small diametered section of the inlet passage 501 of the switch valve 50. The small diametered tube section 521 of the discharge head 52 is inserted into the inlet passage 501 of the switch valve 50. Then the small seal ring 41 is attached to the small diametered section of the passage hole 402 of the rinsing shower head embodiment 40. Afterwards, the switch valve 50 together with the discharge head 52 is housed in the large portion of the two staged passage hole 402 of the rinsing shower head embodiment 40. The water inlet hole 506 of the switch valve 50 is in communication with a water delivery conduct 405 of the rinsing shower head embodiment 40. The driving end 511 of the valve shaft 51 sticks into the control chamber 403 of the rinsing shower head embodiment 40. The bubble generator 60 and the large seal ring 53 are placed into the receiving cavity 71 of the outlet cap 70 which is then secured to the rinsing shower head embodiment 40 by engaging the internally threaded section 73 with the external threads 401.

The pivot projection 433 of the press button board 43 is engaged with the abutment groove 404 of the control chamber 403 of the rinsing shower head embodiment 40. At the same time the driving section 432 of the press button board 43 is disposed next to the end of the valve shaft 51 in the control chamber 403, then the central activation hole 421 of the deformable cap 42 is forced into snap engagement with the driving end 511 of the valve shaft 51 which sticks out in the control chamber 403 at the back of the rinsing shower head embodiment 40. Thereby, the valve shaft 51 can be linearly moved forwardly or backwardly by the deformable cap 42 which is pushed or pulled back and forth. At last, the sealing hoop 44 as well as the flexible cover 45 is attached to the control chamber 403 at the back of the rinsing shower head embodiment 40 to complete the assembly.

Figure 3:
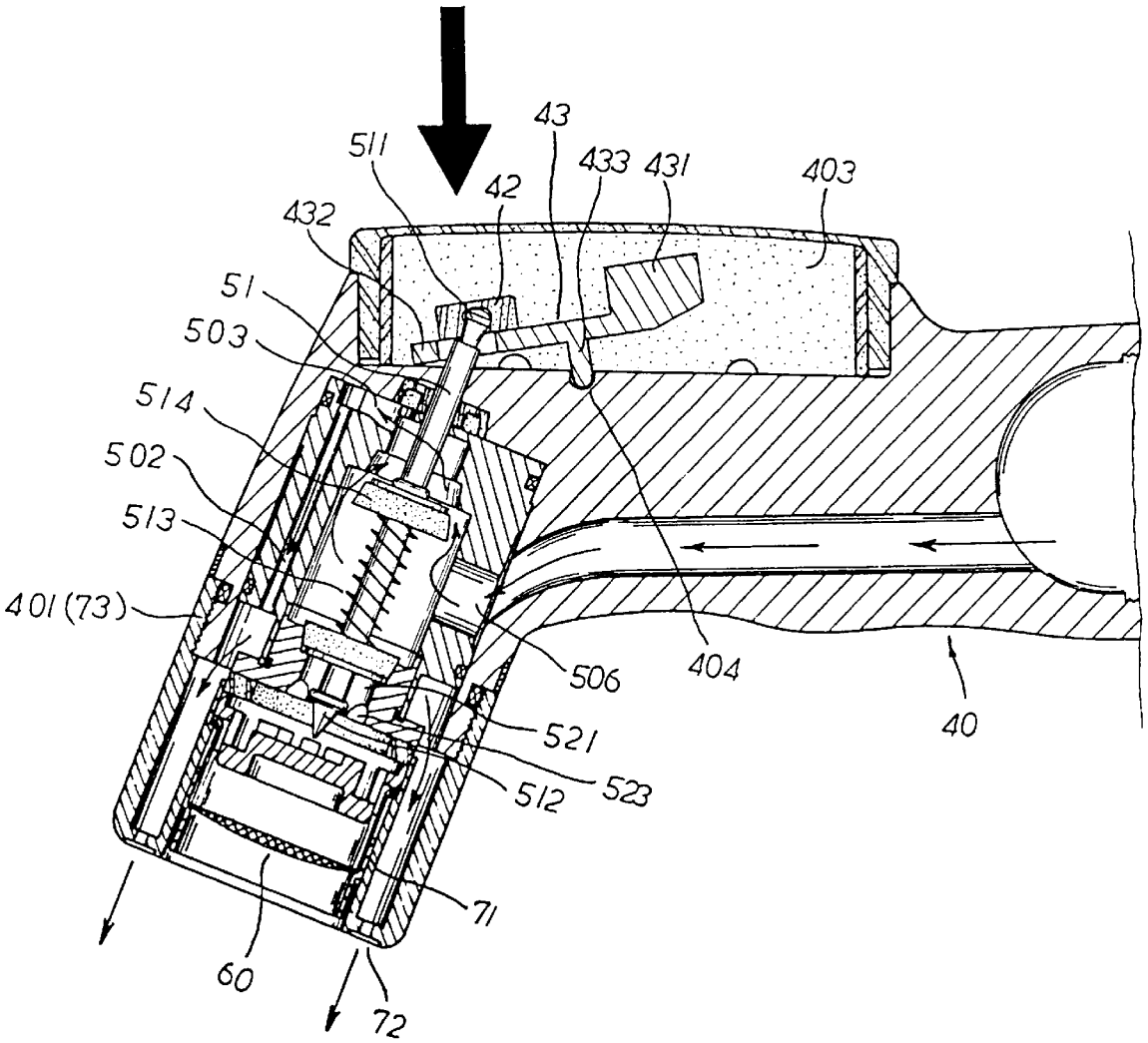
FIG. 3 is a sectional diagram showing the first operation mode of the present invention.

In operation, the rinsing shower head embodiment 40 is connected to a water pipe which is opened to let running water flow into the shower head embodiment 40 via the delivery conduct 405 and the inlet hole 506 of the switch valve 50 and further flow into the inlet passage 501 of the switch valve 50. Referring to FIG. 3, when the front portion of the soft cover 45 is pressed down, the press button board 43 will be pivoted at one end to push against the valve shaft 50 and force the bias spring 513 to compress at the same time, causing the sealing bulges 514 placed at the middle of the valve shaft 50 to move toward each other. This results in the opening of the front end of the inlet passage 501 normally blocked by one of the sealing bulges 514 so that water will rush in via inlet passage 501 and the outlet hole 505 of the switch valve 50 and further into the bypass 503 and to the outlet slot passage 502 of the switch valve 50. Water is finally discharged via the outlet bores 72 of the outlet cap 70.

Figure 4:
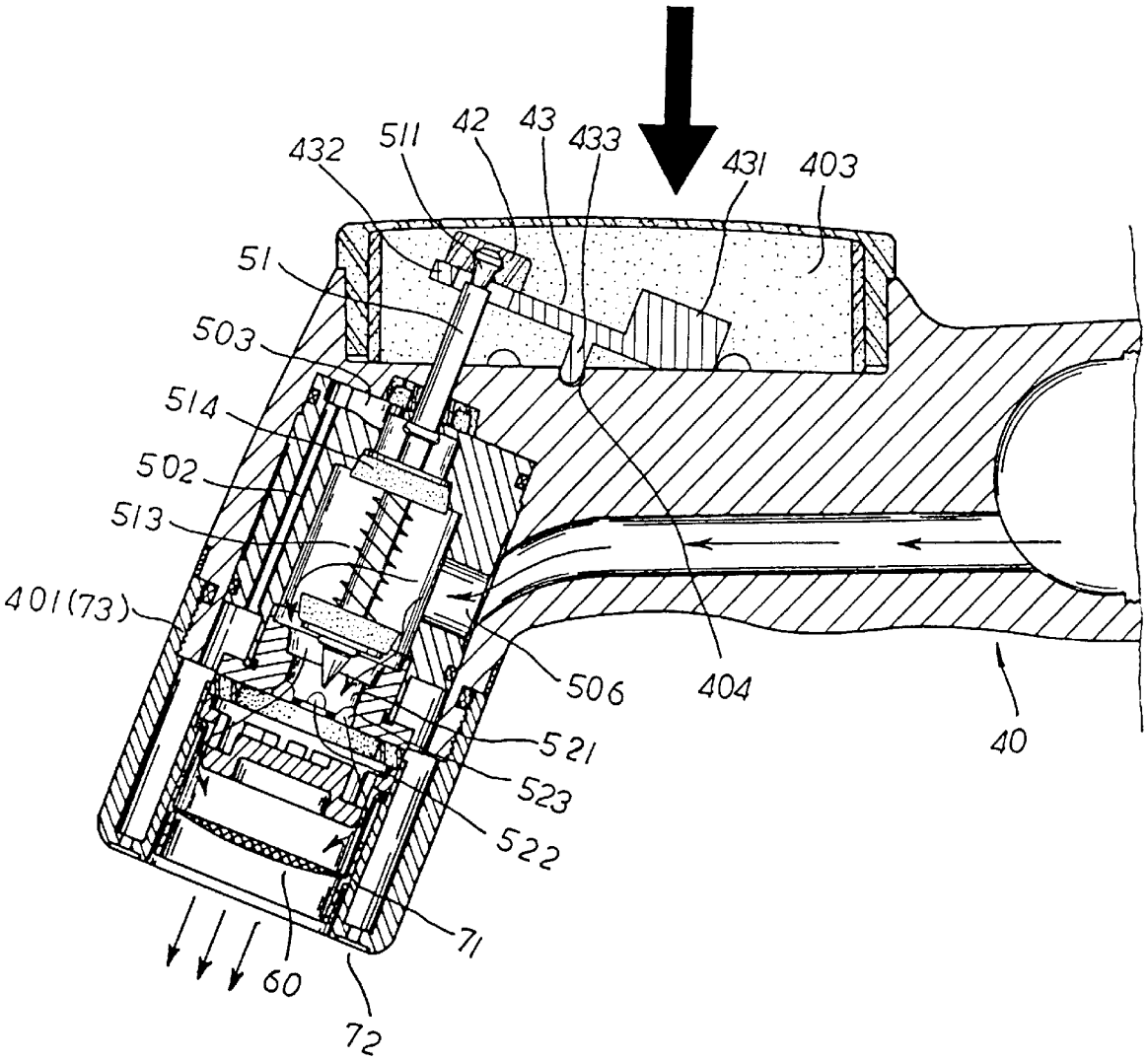
FIG. 4 is a diagram showing the second operation mode of the present invention.

Referring to FIG. 4, as the rear portion of the soft cover 45 is pressed, the front end of the press button board 43 is pivoted away from the switch valve 50, causing the deformable cap 42 to bring the valve shaft 51 to move away from the switch valve 50. In that case, the sealing bulge 514 positioned at the conic dodge head 512 of the valve shaft 50 is forced to move toward the other sealing bulge 514 at the opposite end of the valve shaft 51, causing the compression of the bias spring 513. Thus, without the blockage of the sealing bulge 514 at the tube section 521 of the discharge head 52, water flowing through the delivery conduct 405 and the inlet hole 506 of the rinsing shower head embodiment 40 is led through the tube section 521 and the discharge holes 523 of the discharge head 52 to the bubble generator 60. Finally water is discharged from the bubble generator 60.

When the soft cover 45 is free of a pressing force, the force produced by the compressed bias spring 513 will bring the sealing bulges 514 back to it original position thereby water is confined in the inlet passage 501 of the switch valve 50 without being discharged via the outlet holes 72 of the outlet cap 70 or the bubble generator 60.

In summary, the improved switch valve of the present invention uses a soft cover 45 to control a pivotal press button board 43 which can be pivoted one way or another so as to control water to be discharged either via the outlet holes 72 or the bubble generator 60 of the outlet cap 70. As the soft cover 45 is free of compression, water flow will be automatically stopped. If water is to be discharged again, a user has only to press down either the upper or lower portion of the soft cover 45 without operating any other external control valve, facilitating a person to control the flow of water without wasting time to switch on or off a valve.

I claim:

1. A rinsing shower head for a kitchen sink, said rinsing shower head comprising a shower head, a small seal ring, a deformable cap, a press button board, a sealing hoop, a flexible cover, a switch valve, a valve shaft, a discharge head, a large seal ring, a bubble generator and an outlet cap; wherein said rinsing shower head has a slightly curved tubular body and has a front water discharge portion and a rear holding handle portion;

said front water discharge portion is of a two-stage structure having a small front end provided with outer locking threads;

at the rear end of the water discharge portion is disposed a a passage hole for mounting of the valve shaft, the passage hole having a large diametered section and a small diametered section;

on a back of said rinsing shower head is disposed a recessed oval-shaped control chamber in which an abutment groove is located;

said deformable cap is of a short circular disc shape having a central activation hole; said press button board has a press section and a driving section having an oval hole defined thereon;

to the opposite side of said press section and at the middle position between said driving section and said press section is disposed a pivot projection;

said switch valve is a two-staged cylinder having a long large diametered section and a short small diametered section;

at each edge of the long large diametered section is disposed a seal ring;

a two-staged water inlet passage extends from the short small diametered section into the large diametered section of said switch valve;

a plurality of arc shaped outlet slot passages are defined on a vertical face at the junction of the small diametered section and the large diametered section of said switch valve;

an arc-shaped bypass communicating with the outlet slots of said switch valve is disposed at the external end of the large diametered section of said switch valve;

a fixing hole is located at an end face of the large diametered section of said switch valve;

a plurality of evenly and radially distributed water outlet holes are disposed around said fixing hole;

said fixing hole and said water outlet holes are in communication with the water inlet passage of said switch valve;

a water inlet hole extends into the large diametered section of said switch valve from the external peripheral surface thereof and communicates with said water inlet passage;

said valve shaft is an elongated rod having a ball-shaped driving end at a rear end; and a front end is provided with a conic dodge head;

a bias spring is disposed at a front section of said valve shaft;

at each end of said bias spring is disposed a sealing bulge;

said discharge head is a two-stage cylinder including a small diametered central tube section and a large diametered disc section having a central location hole with four evenly distributed discharge holes disposed around said location hole;

in communication with said central tube section are said central location hole and said discharge holes;

said outlet cap is a tubular cap having a large receiving, cavity and a plurality of water outlet holes disposed on a peripheral wall at the front end thereof;

said receiving cavity extends a proper length into said outlet cap which is provided with an internally threaded section at the other end opposite to said receiving cavity;

whereby said valve shaft is led into engagement with the fixing hole and said sealing bulges are engaged with the small diametered section of said inlet passage of said switch valve;

said small diametered tube section of said discharge head is inserted into said inlet passage of said switch valve;

said small seal ring is attached to the small diametered section of said passage hole of said rinsing shower head;

said switch valve together with said discharge head is housed in the large diametered portion of the passage hole of said rinsing shower head;

said water inlet hole of said switch valve is in communication with a water delivery conduit of said rinsing shower head;

said driving end of the valve shaft sticks into said control chamber of said rinsing shower head;

said bubble generator and the large seal ring are placed into the receiving cavity of said outlet cap which is then secured to the rinsing shower head by engaging the internally threaded section with the external threads of said shower head;

said pivot projection of the press button board is engaged with the abutment groove of the control chamber of the rinsing shower head;

said driving section of the press button board is disposed next to the end of said valve shaft in the control chamber; then said central activation hole of the deformable cap is forced into snap engagement with the driving end of said valve shaft which sticks out in the control chamber at the back of said rinsing shower head;

said valve shaft can be linearly moved forwardly or backwardly by said deformable cap which is pushed or pulled back and forth by said press button board;

said sealing hoop as well as said flexible cover is attached to said control chamber at the back of said rinsing shower head;

said rinsing shower head is connectable to a water pipe which is opened to let running water flow into the shower head via the delivery conduit and the inlet hole of said switch valve and further flow into said inlet passage of said switch valve;

when the front portion of said soft cover is pressed down, said press button board will be pivoted at one end to push against said valve shaft and force said bias spring to compress at the same time, causing said sealing bulges to move toward each other, resulting in the opening of the front end of said inlet passage normally blocked by one of the sealing bulges so that water will rush in via said inlet passage and said outlet hole of said switch valve and further into said bypass and to said outlet slot passage of said switch valve; water is finally discharged via the outlet bores of said outlet cap;

as the rear portion of said soft cover is pressed, the front end of the press button board is pivoted away from the switch valve, causing said deformable cap to bring the valve shaft to move away from said switch valve, causing the sealing bulge positioned at the conic dodge head of said valve shaft to move toward the other sealing bulge at the opposite end of said valve shaft, causing the compression of said bias spring; thus, without the blockage of said sealing bulge at said tube section of said discharge head, water flowing through the delivery conduit and the inlet hole of the rinsing shower head is led through the tube section and the discharge holes of said discharge head and is discharged via said bubble generator; when said soft cover is free of a pressing force, the compressed bias spring will bring said sealing bulge backs to its original position thereby water is confined in the inlet passage of said switch valve without being discharged via the outlet holes of said outlet cap or said bubble generator.

* * * * *